US008165486B2

(12) United States Patent
Yasuda

(10) Patent No.: US 8,165,486 B2
(45) Date of Patent: Apr. 24, 2012

(54) IMAGE FORMING APPARATUS HAVING TEMPERATURE DETECTION MEMBER AND TEMPERATURE CORRECTION UNIT

(75) Inventor: Masaki Yasuda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 432 days.

(21) Appl. No.: 12/362,087

(22) Filed: Jan. 29, 2009

(65) Prior Publication Data

US 2009/0208237 A1 Aug. 20, 2009

(30) Foreign Application Priority Data

Jan. 30, 2008 (JP) ..... 2008-019567

(51) Int. Cl.
*G03G 15/20* (2006.01)

(52) U.S. Cl. ..... 399/69; 399/92; 399/94

(58) Field of Classification Search ..... 399/44, 399/69, 92, 94
See application file for complete search history.

(56) References Cited

FOREIGN PATENT DOCUMENTS

| | | |
|---|---|---|
| JP | 10-240104 | 9/1998 |
| JP | 2000-039800 | 2/2000 |
| JP | 2002-132085 | 5/2002 |
| JP | 2003-241566 | 8/2003 |
| JP | 2007-163884 | 6/2007 |

OTHER PUBLICATIONS

Japanese Office Action received for counterpart JP Application No. 2008-019567, mailed Jan. 7, 2010.

*Primary Examiner* — Hoang Ngo
(74) *Attorney, Agent, or Firm* — Banner & Witcoff, Ltd.

(57) ABSTRACT

An image forming apparatus is provided. The image forming apparatus includes an apparatus main unit; a detected unit that is placed in the apparatus main unit; a temperature detection member that is provided out of contact with the detected unit in the apparatus main unit for detecting a temperature of the detected unit; a change member for changing a state of an air current in the apparatus main unit; and a temperature correction unit for correcting a value relevant to the temperature detected by the temperature detection member based on change of the state of the air current by the change member.

4 Claims, 3 Drawing Sheets

IMAGE FORMING APPARATUS HAVING TEMPERATURE DETECTION MEMBER AND TEMPERATURE CORRECTION UNIT

CROSS REFERENCE TO RELATED APPLICATION

The present application claims priority from Japanese Patent Application No. 2008-019567, which was filed on Jan. 30, 2008, the disclosure of which is herein incorporated by reference in its entirety.

TECHNICAL FIELD

Apparatuses consistent with the present invention relate to an image forming apparatuses such as an electro-photographic color printer.

BACKGROUND

Japanese unexamined patent application publication No. JP-A-2007-163884 describes a related art image forming apparatus. The related art image forming apparatus such as an electro-photographic color printer is provided with a fixing unit for fixing toner transferred to a sheet onto the sheet. The fixing unit includes a heating roller and a pressing roller placed in a press state against the heating roller. The sheet with toner transferred thereto is conveyed through the nip between the heating roller and the pressing roller. While the sheet passes between the heating roller and the pressing roller, the toner is fixed onto the sheet by heating and pressing.

To control the fixing temperature, the fixing unit is provided with a temperature sensor for detecting the surface temperature of the heating roller or the pressing roller. For example, a fixing unit in the related art image forming apparatus has a noncontact thermistor placed at a predetermined distance from the surface of a pressing sensor. Output of a heater provided in the pressing roller is controlled so that the temperature detected by the noncontact thermistor becomes a predetermined target fixing temperature.

SUMMARY

However, the related art image forming apparatus has a few disadvantages. For example, the temperature detected by the noncontact thermistor may deviate from the actual temperature of the surface of the pressing roller. If the temperature deviates, the actual temperature of the surface of the pressing roller deviates from the target fixing temperature and a problem of a curl of a sheet caused by overheating, a fixing failure caused by heat shortage, etc., occurs.

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus capable of precisely acquiring the actual temperature of a detected unit based on the detected temperature of a noncontact temperature detection member.

According to an exemplary embodiment of the present invention, there is provided an image forming apparatus comprising: an apparatus main unit; a detected unit that is placed in the apparatus main unit; a temperature detection member that is provided out of contact with the detected unit in the apparatus main unit for detecting a temperature of the detected unit; a change member for changing a state of an air current in the apparatus main unit; and a temperature correction unit for correcting a value relevant to the temperature detected by the temperature detection member based on change of the state of the air current by the change member.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

1. General Configuration of Printer

Figure 1:
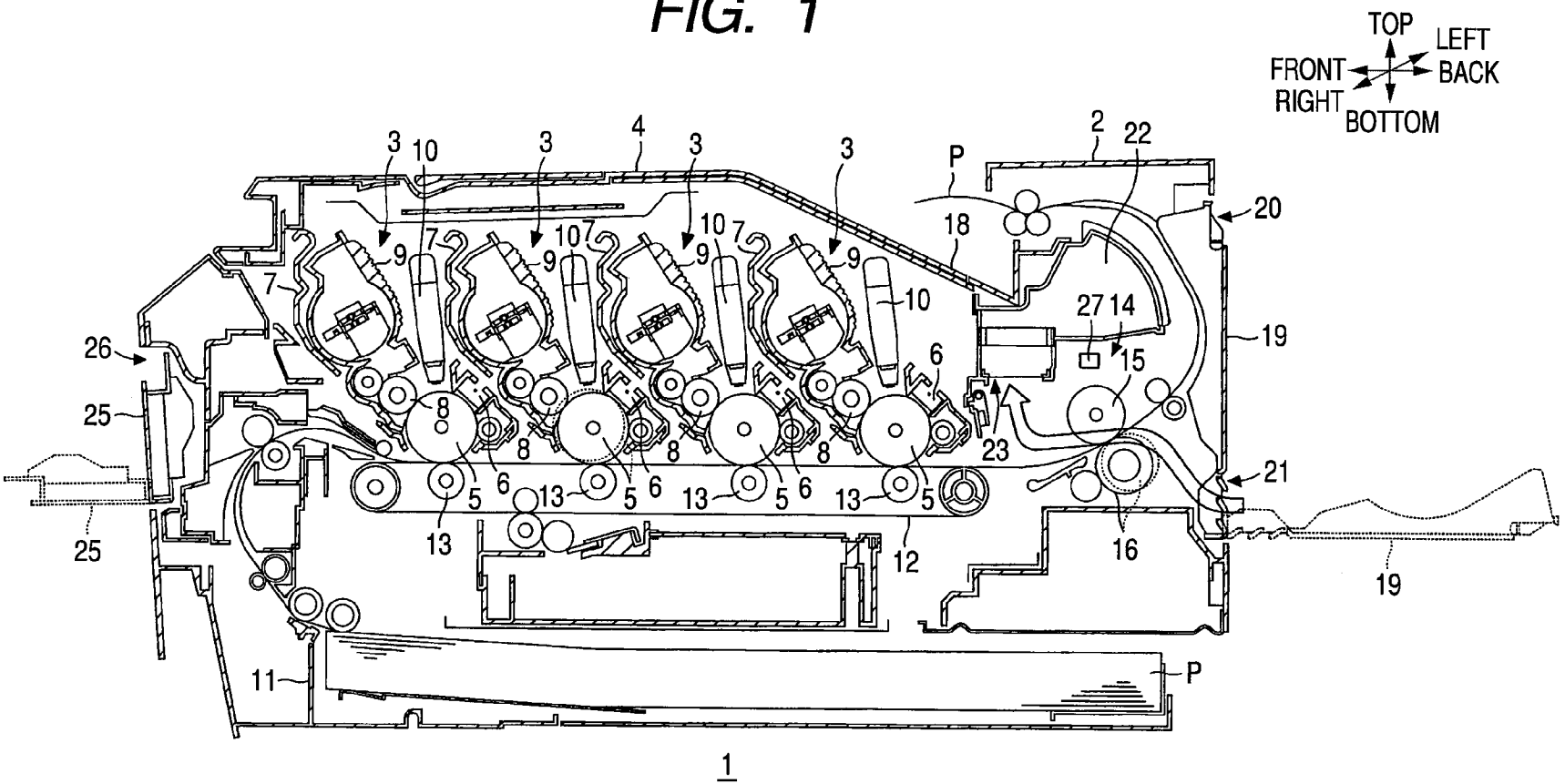
FIG. 1 is a sectional side view to show a printer as an example of an image forming apparatus of the exemplary embodiment of the present invention.

FIG. 1 is a sectional side view to show a printer as an example of an image forming apparatus of the first exemplary embodiment of the present invention.

A printer 1 is a tandem color printer. In a main casing 2 as an example of an apparatus main unit, four process cartridges 3 are placed in parallel corresponding to colors of black, yellow, magenta, and cyan. Each of the process cartridges 3 can be placed in and detached from the main casing 2 in a state in which a top cover 4 of the top face of the main casing 2 is opened.

Each of the process cartridges 3 has a drum cartridge 7 for holding a photoconductive drum 5 and a scorotron charger 6 and a developing cartridge 9 for holding a developing roller 8, the developing cartridge 9 detachably placed in the drum cartridge 7. The surface of the photoconductive drum 5 is uniformly charged by the scorotron charger 6 and then is selectively exposed by an LED provided in an LED unit 10. Accordingly, an electrostatic latent image based on image data is formed on the surface of the photoconductive drum 5. The electrostatic latent image is visualized by toner carried on the developing roller 8 and a toner image is formed on the surface of the photoconductive drum 5.

A sheet P is housed in a sheet feeding cassette 11 placed on the bottom of the main casing 2. The sheets P housed in the sheet feeding cassette 11 are conveyed one at a time onto a conveying belt 12 as an example of a belt by various rollers. The conveying belt 12 is placed facing the four photoconductive drums 5 from below. The sheet P conveyed onto the conveying belt 12 passes through the nip between the conveying belt 12 and each of the photoconductive drums 5 in sequence as the conveying belt 12 runs. When the toner image on the surface of the photoconductive drum 5 faces the sheet P, it is transferred onto the sheet P by a transfer bias applied to a transfer roller 13. The transfer rollers 13 are placed facing the photoconductive drums 5 in a one-to-one correspondence with each other across the conveying belt 12.

The upstream side in the conveying direction of the sheet P by the conveying belt 12 is assumed to be the front of the printer 1, and the left and the right in the printer 1 are applied when the printer 1 is viewed from the front.

The sheet P with the toner image transferred thereto is conveyed to a fixing unit 14, which then fixes the toner image onto the sheet P by heating and pressing. Specifically, the fixing unit 14 includes a heating roller 15 as an example of a heating member of a detected member and a pressing roller 16 brought into press contact with the heating roller 15 from below. The heating roller 15 includes a metal pipe having a surface coated with a fluorocarbon resin and a halogen lamp 17 (see FIG. 2) inserted into the metal pipe for heating. The pressing roller 16 has a metal roller shaft covered with a rubber material. While the sheet P passes through the nip between the heating roller 15 and the pressing roller 16, the toner image is fixed onto the sheet P by heating and pressing.

The sheet P with the toner image fixed thereonto is discharged onto a sheet discharge tray 18 formed on the top face of the top cover 4 or is discharged onto a rear cover tray 19 as an example of a change member of a guide member attached to the back (rear) of the main casing 2. The rear cover tray 19 is provided as it can be opened and closed between a state in which it is inclined to the back of the main casing 2 and forms an opening 20 at the back of the main casing 2 and a state in which it extends along the back of the main casing 2 and closes the opening 20. The inner face of the rear cover tray 19 forms a part of a sheet discharge path of the sheet P proceeding toward the sheet discharge tray 18 in a state in which the rear cover tray 19 is closed. Therefore, the sheet P conveyed from the fixing unit 14 is discharged onto the sheet discharge tray 18 in a state in which the rear cover tray 19 is closed. On the other hand, the sheet P conveyed from the fixing unit 14 is discharged onto the rear cover tray 19 in a state in which the rear cover tray 19 is opened.

The rear cover tray 19 is formed in a base end part (lower end part of the rear cover tray 19 in a state in which the rear cover tray 19 is closed) with a plurality of intake ports 21 shaped like slits to take outside air into the main casing 2.

The printer 1 is provided with an exhaust air duct 22 for exhausting hot air from the fixing unit 14 above the fixing unit 14. The exhaust air duct 22 has an inlet 23 opened downward in front of the heating roller 15. A fan 24 (see FIG. 2) is provided in the exhaust air duct 22. When the fan 24 is driven, an atmosphere in the proximity of the fixing unit 14 is sucked into the exhaust air duct 22 through the inlet 23 and is exhausted through the exhaust air duct 22 to the outside of the main casing 2. As the atmosphere is exhausted, the air outside the main casing 2 flows through the intake ports 21 into the main casing 2. The air flowing into the main casing 2 flows toward the inlet 23 of the exhaust air duct 22 by the action of the fan 24. Accordingly, in the main casing 2, an air current from the intake ports 21 through the proximity of the heating roller 15 to the inlet 23 is formed as indicated by an open arrow in FIG. 1.

The printer 1 also includes a manual tray 25 as an example of a sheet feed tray. The manual tray 25 is provided as it can be opened and closed between a state in which it is inclined to the front of the main casing 2 and forms an opening 26 at the front of the main casing 2 and a state in which it extends along the front of the main casing 2 and closes the opening 26. If a command to feed a sheet from the manual tray 25 is given in a state in which the manual tray 25 is opened and a sheet P is placed on the manual tray 25, the sheets P on the manual tray 25 are conveyed one at a time onto the conveying belt 12.

2. Control System of Printer

Figure 2:
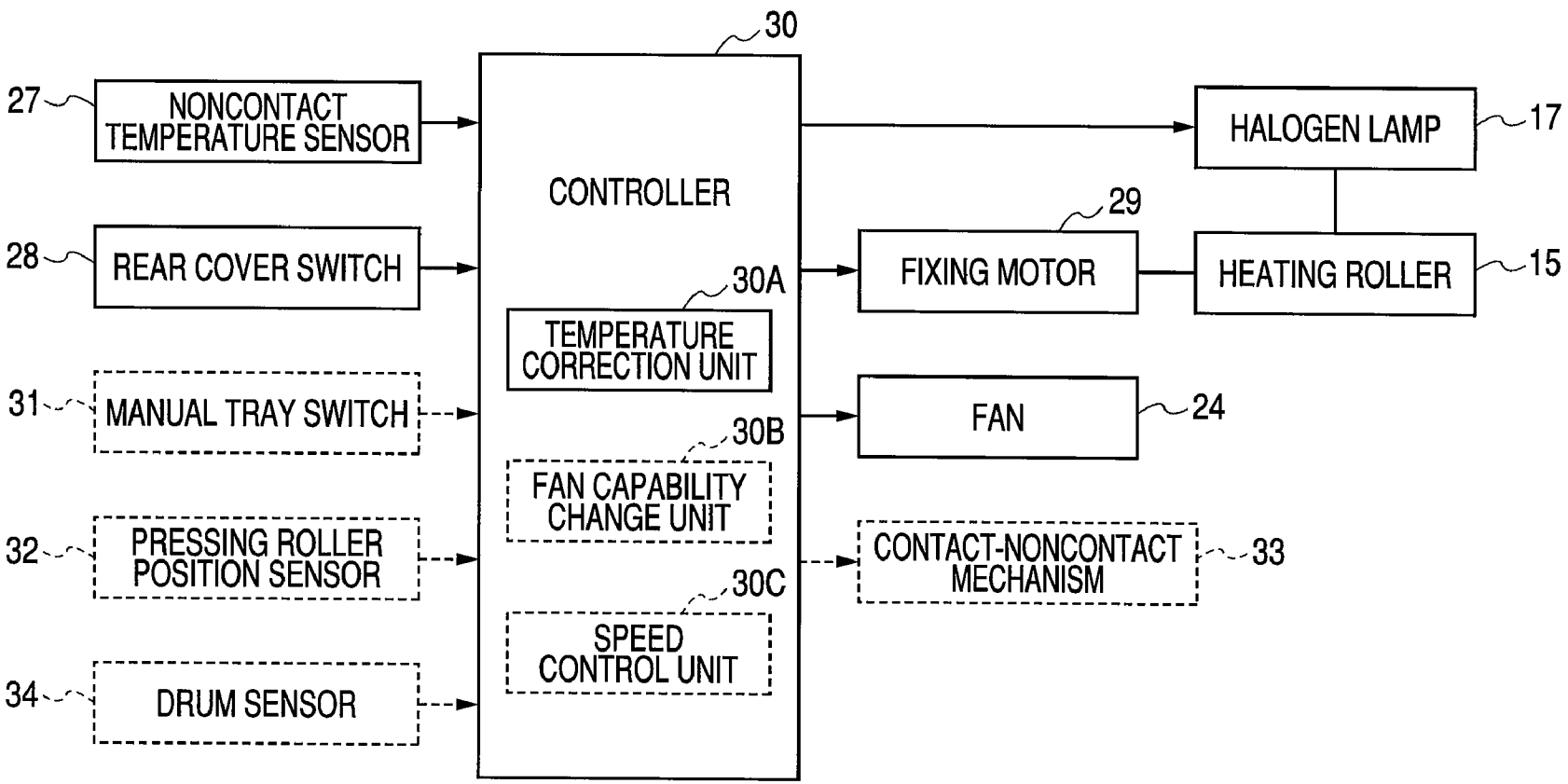
FIG. 2 is a block diagram to show a control system of the printer.

FIG. 2 is a block diagram to show a control system of the printer.

The printer 1 includes a controller 30 implemented as a microcomputer containing a CPU, RAM, ROM, etc. The printer 1 also includes a noncontact temperature sensor 27 as an example of a temperature detection member for detecting the surface temperature of the heating roller 15, a rear cover switch 28 for detecting opening/closing of the rear cover tray 19, and a fixing motor 29 for driving the heating roller 15. The noncontact temperature sensor 27 is placed out of contact with the heating roller 15 with a spacing above the heating roller 15, as shown in FIG. 1. The rear cover switch 28 is provided in association with the rear cover tray 19. For example, the switch is turned on in a state in which the rear cover tray 19 is closed; the switch is turned off in a state in which the rear cover tray 19 is opened. Detection signals of the noncontact temperature sensor 27 and the rear cover tray 19 are input to the controller 30.

The halogen lamp 17, the fan 24, and the fixing motor 29 are connected to the controller 30 for controlling the components.

The controller 30 substantially includes a temperature correction unit 30A for correcting the temperature detected by the noncontact temperature sensor 27 (detected temperature) The temperature correction unit 30A is a function processing unit implemented as software as the CPU executes a program stored in the ROM.

The noncontact temperature sensor 27 has a resistance element whose resistance value changes in response to the radiation amount from the heating roller 15, and a given voltage is applied to the resistance element from a power supply. Thus, if the radiation amount from the heating roller 15 changes, the amount of a current flowing through the resistance element changes. The noncontact temperature sensor 27 outputs the current flowing through the resistance element as a detection signal, for example. The temperature correction unit 30A calculates the temperature (detected temperature) from the detection signal output by the noncontact temperature sensor 27 and corrects the calculated detected temperature (temperature data) as described below. In the first exemplary embodiment, the detected temperature is an example of a value relevant to the temperature detected by the temperature detection member.

3. Temperature Correction

Figure 3:
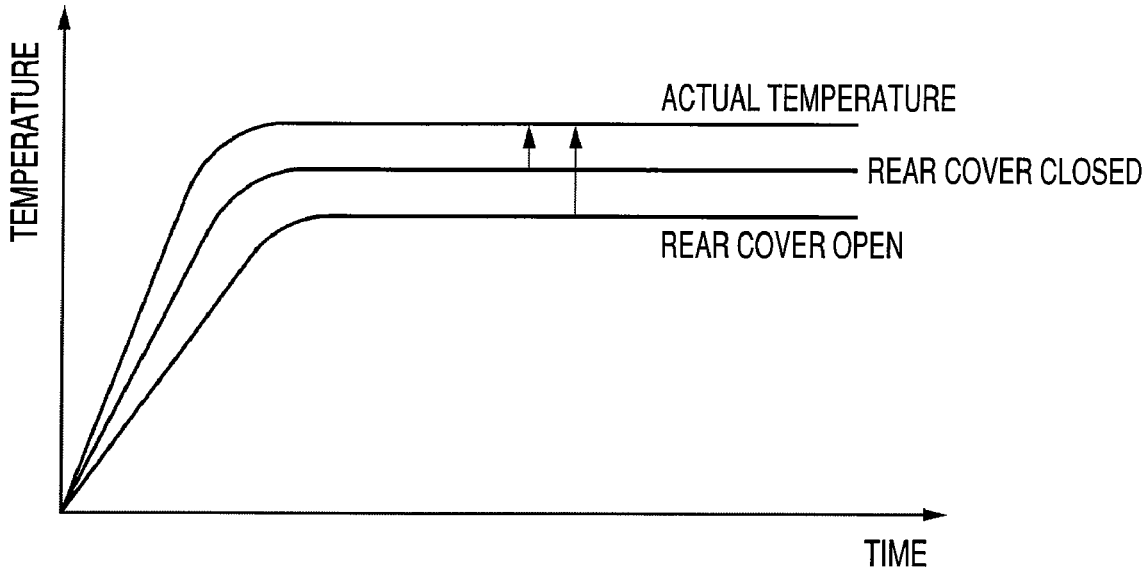
FIG. 3 is a graph to describe temperature correction executed by a temperature correction unit.

FIG. 3 is a graph to describe temperature correction executed by the temperature correction unit 30A.

In the state in which the rear cover tray 19 is closed, an air current from the intake ports 21 through the proximity of the heating roller 15 to the inlet 23 of the exhaust air duct 22 is formed in the main casing 2 as previously described with reference to FIG. 1. When the rear cover tray 19 is opened, the opening 20 is formed in the rear of the main casing 2 and thus an air current from the opening 20 through the proximity of the heating roller 15 to the inlet 23 of the exhaust air duct 22 is formed in the main casing 2. At this time, the air current is stronger than the air current formed when the rear cover tray 19 is closed.

As the strength of the air current passing through the proximity of the heating roller 15 changes, the strength of the air current passing between the heating roller 15 and the noncontact temperature sensor 27 changes accordingly and thus the detected temperature of the noncontact temperature sensor 27 changes. Specifically, as shown in FIG. 3, when the rear cover tray 19 is closed, the air current is relatively weak and thus the detected temperature of the noncontact temperature sensor 27 is relatively close to the actual temperature of the surface of the heating roller 15; when the rear cover tray 19 is opened, the air current is relatively strong and thus the detected temperature of the noncontact temperature sensor 27 is relatively away from the actual temperature of the surface of the heating roller 15.

Then, the temperature correction unit 30A corrects the detected temperature of the noncontact temperature sensor 27 based on change in the state of the air current formed in the main casing 2. Specifically, the temperature correction unit 30A sets a temperature correction coefficient based on on/off of the rear cover switch 28 and multiplies the detected temperature of the noncontact temperature sensor 27 by the setup temperature correction coefficient, thereby correcting the detected temperature of the noncontact temperature sensor 27 so as to match the actual temperature of the surface of the heating roller 15. Here, the temperature correction unit 30A may add the temperature correction coefficient to the detected temperature instead of multiplying the detected temperature by the temperature correction coefficient. If the rear cover tray 19 is closed and the rear cover switch 28 is on, the deviation of the detected temperature of the noncontact temperature sensor 27 from the actual temperature of the surface of the heating roller 15 is relatively small and thus the temperature correction coefficient (correction amount) is set to a relatively small value. On the other hand, if the rear cover tray 19 is opened and the rear cover switch 28 is off, the deviation of the detected temperature of the noncontact temperature sensor 27 from the actual temperature of the surface of the heating roller 15 is relatively large and thus the temperature correction coefficient (correction amount) is set to a relatively large value.

The controller 30 controls output of the halogen lamp 17 so that the post-corrected detected temperature becomes the predetermined target fixing temperature based on the detected temperature of the noncontact temperature sensor 27 after corrected by the temperature correction unit 30A. Accordingly, the temperature of the surface of the heating roller 15 can be set to the target fixing temperature. Thus, good fixing of the tone image onto the sheet P can be accomplished without introducing a problem of a curl of the sheet P caused by overheating, a fixing failure caused by heat shortage, etc. Consequently, a high-quality image can be formed on the sheet P.

4. Advantages

As described above, the noncontact temperature sensor 27 for detecting the temperature of the heating roller 15 is placed out of contact with the heating roller 15 in the main casing 2. The main casing 2 is provided with the rear cover tray 19 for guiding and receiving the sheet P with the toner image fixed thereto by the heating roller 15. The rear cover tray 19 is provided as the position of the rear cover tray 19 can be changed between the open position and the closed position. When the rear cover tray 19 is set to the open position, the opening 20 is formed in the rear of the main casing 2 and when the rear cover tray 19 is set to the closed position, the opening 20 is closed by the rear cover tray 19. Thus, the position of the rear cover tray 19 is changed between the open position and the closed position, whereby the opening 20 is opened and closed and accordingly the state of the air current formed in the main casing 2 is changed.

The temperature detected by the noncontact temperature sensor 27 is corrected by the temperature correction unit 30A based on the position of the rear cover tray 19. Thus, the actual temperature of the heating roller 15 can be precisely acquired based on the detected temperature of the noncontact temperature sensor 27 regardless of change in the state of the air current accompanying the position change of the rear cover tray 19.

5. Second Exemplary Embodiment

A printer 1 is provided with a fan 24 for forcibly exhausting air in a main casing 2 to the outside as shown in FIG. 2. The capability of the fan 24 is changed by a controller 30 substantially including a fan capability change unit 30B indicated by a dashed line in FIG. 2. For example, the capability of the fan 24 is set to weak in a sleep state in which the image formation operation of the printer 1 is not performed; the capability of the fan 24 is set to strong during the image formation operation. When the capability of the fan 24 is changed, the exhaust air current amount from the inside of the main casing 2 to the outside changes and accordingly the state of the air current passing through the proximity of a heating roller 15 is changed. That is, if the capability of the fan 24 is enhanced (set to strong), the exhaust air current amount from the inside of the main casing 2 to the outside increases and the air current passing through the proximity of the heating roller 15 becomes strong. On the other hand, if the capability of the fan 24 is lowered (set to weak), the exhaust air current amount from the inside of the main casing 2 to the outside decreases and the air current passing through the proximity of the heating roller 15 becomes weak.

As the strength of the air current passing through the proximity of the heating roller 15 changes, the strength of the air current passing between the heating roller 15 and a noncontact temperature sensor 27 changes accordingly and thus the detected temperature of the noncontact temperature sensor 27 changes.

Then, a temperature correction unit 30A may set a temperature correction coefficient based on strong/weak of the capability of the fan 24 (for example, based on capability control of the fan 24 by the fan capability change unit 30B) and may multiply the detected temperature of the noncontact temperature sensor 27 by the setup temperature correction coefficient, thereby correcting the detected temperature of the noncontact temperature sensor 27 so as to match the actual temperature of the surface of the heating roller 15. When the capability of the fan 24 is set to weak, the temperature correction coefficient is set to a relatively small value. On the other hand, when the capability of the fan 24 is set to strong, the temperature correction coefficient is set to a relatively large value. (This means that in the state in which the capability of the fan 24 is set to strong, the correction amount of the detected temperature in the temperature correction unit 30A becomes large as compared with the state in which the capability of the fan 24 is set to weak.)

Accordingly, the actual temperature of the heating roller 15 can be precisely acquired based on the detected temperature of the noncontact temperature sensor 27 regardless of change in the state of the air current accompanying change of the capability of the fan 24.

6. Third Exemplary Embodiment

A main casing 2 is provided with a manual tray 25 for feeding a sheet P into the main casing 2 so that the position of the manual tray 25 can be changed between an open position and a closed position. When the manual tray 25 is set to the open position, an opening 26 is formed in the main casing 2 and when the manual tray 25 is set to the closed position, the opening 26 is closed by the manual tray 25. Thus, the position of the manual tray 25 is changed between the open position and the closed position, whereby the opening 26 is opened and closed and accordingly the state of the air current formed in the main casing 2 is changed.

Then, a detection signal of a manual tray switch 31 to detect open/closed of the manual tray 25 may be input to a controller 30, as indicated by a dashed line in FIG. 2. The manual tray switch 31 is provided in the proximity of the front of the main casing 2 in association with of the manual tray 25. The manual tray switch 31 is turned on in a state in which the manual tray 25 is closed; the manual tray switch 31 is turned off in a state in which the manual tray 25 is opened.

A temperature correction unit 30A may set a temperature correction coefficient based on on/off of the manual tray switch 31 and may multiply the detected temperature of a noncontact temperature sensor 27 by the setup temperature correction coefficient, thereby correcting the detected temperature of the noncontact temperature sensor 27 so as to match the actual temperature of the surface of a heating roller 15. If the manual tray 25 is closed and the manual tray switch 31 is on, the temperature correction coefficient is set to a relatively small value. On the other hand, if the manual tray 25 is opened and the manual tray switch 31 is off, the temperature correction coefficient is set to a relatively large value.

Accordingly, the actual temperature of the heating roller 15 can be precisely acquired based on the detected temperature of the noncontact temperature sensor 27 regardless of change in the state of the air current accompanying opening/closing of the manual tray 25.

7. Fourth Exemplary Embodiment

Sheets P differ in heat capacity according to the thickness. If the thickness of the sheet P is relatively large (if the sheet P is a cardboard), it takes time in fixing a toner image onto the sheet P as compared with the case where the thickness of the sheet P is relatively small (if the sheet P is ordinary paper). Thus, a speed control unit 30C (indicated by a dashed line in FIG. 2) substantially included in a controller 30 may control driving of a fixing motor 29 to change the rotation speed of a heating roller 15 in response to the thickness of the sheet P. That is, if the sheet P is a cardboard, the rotation speed of the heating roller 15 may be relatively decreased; if the sheet P is ordinary paper, the rotation speed of the heating roller 15 may be relatively increased.

When the rotation speed of the heating roller 15 is changed, the conveying speed of the sheet P changes in the fixing unit 14 and accordingly the state of the air current formed in a main casing 2 (in the proximity of the heating roller 15) is changed. That is, when the rotation speed of the heating roller 15 is increased, the air current passing through the proximity of the heating roller 15 becomes strong. On the other hand, when the rotation speed of the heating roller 15 is decreased, the air current passing through the proximity of the heating roller 15 becomes weak.

As the strength of the air current passing through the proximity of the heating roller 15 changes, the strength of the air current passing between the heating roller 15 and a noncontact temperature sensor 27 changes accordingly and thus the detected temperature of the noncontact temperature sensor 27 changes.

Then, a temperature correction unit 30A may set a temperature correction coefficient based on the rotation speed of the heating roller 15 (for example, based on drive control of the fixing motor 29 by the speed control unit 30C) and may multiply the detected temperature of the noncontact temperature sensor 27 by the setup temperature correction coefficient, thereby correcting the detected temperature of the noncontact temperature sensor 27 so as to match the actual temperature of the surface of the heating roller 15. When the rotation speed of the heating roller 15 is high, the temperature correction coefficient is set to a relatively large value. On the other hand, when the rotation speed of the heating roller 15 is low, the temperature correction coefficient is set to a relatively small value.

Accordingly, the actual temperature of the heating roller 15 can be precisely acquired based on the detected temperature of the noncontact temperature sensor 27 regardless of change in the state of the air current accompanying change of the rotation speed of the heating roller 15.

8. Fifth Exemplary Embodiment

In a printer 1, there is a fear of causing a sheet P to bend along the peripheral surface of a heating roller 15 or a pressing roller 16, namely, causing a sheet curl to occur depending on the pressing state of the sheet P, etc., by the heating roller 15 and the pressing roller 16 as an example of a pressing member. Thus, the pressing roller 16 may be provided so as to be able to make a relative move to the heating roller 15 (able to make position change) as indicated by a dashed line in FIG. 1 and the position of the pressing roller 16 relative to the heating roller 15 is changed in response to the state of the sheet curl (state in which the toner transfer face of the sheet P is bent like a convex or a concave), thereby making it possible to correct the sheet curl.

When the position of the pressing roller 16 relative to the heating roller 15 is changed, the conveying passage of the sheet P is changed in the proximity of the heating roller 15 and accordingly the state of the air current formed in a main casing 2 (in the proximity of the heating roller 15) is changed.

Then, a detection signal of a pressing roller position sensor 32 for detecting the position of the pressing roller 16 may be input to a controller 30 as indicated by a dashed line in FIG. 2. The pressing roller position sensor 32 is implemented as a micro switch, for example. When the pressing roller 16 is at a position indicated by a solid line in FIG. 1, the pressing roller position sensor 32 is turned on; when the pressing roller 16 is at a position indicated by a dashed line in FIG. 1, the pressing roller position sensor 32 is turned off.

A temperature correction unit 30A may set a temperature correction coefficient based on the position of the pressing roller 16 (for example, based on on/off of the micro switch) and may multiply the detected temperature of a noncontact temperature sensor 27 by the setup temperature correction coefficient, thereby correcting the detected temperature of the noncontact temperature sensor 27 so as to match the actual temperature of the surface of the heating roller 15.

Accordingly, the actual temperature of the heating roller 15 can be precisely acquired based on the detected temperature of the noncontact temperature sensor 27 regardless of change in the state of the air current accompanying change of the position of the pressing roller 16.

9. Sixth Exemplary Embodiment

When a monochrome image is formed, a toner image is formed only on a black photoconductive drum 5 and is not formed on a yellow, magenta, or cyan photoconductive drum 5. Thus, it is desirable that the yellow, magenta, and cyan photoconductive drums 5 should be brought out of contact with a conveying belt 12 to prevent consumption of the photoconductive drums 5 as an example of an image formation member. To do this, a contact-noncontact mechanism 33 for bringing the yellow, magenta, and cyan photoconductive drums 5 into and out of contact with the conveying belt 12 may be provided as indicated by a dashed line in FIG. 1 in a main casing 2. In FIG. 1, to prevent complication of the drawing, only the state in which one (magenta) photoconductive drum 5 is brought out of contact with the conveying belt 12 is indicated by a dashed line.

When the position of each photoconductive drum 5 is changed, the state of the air current formed in the main casing 2 is changed accordingly.

Then, a detection signal of a drum sensor 34 for detecting the position of the photoconductive drum 5 may be input to a controller 30 as indicated by a dashed line in FIG. 2. A temperature correction unit 30A may set a temperature correction coefficient based on the position of each photoconductive drum 5 (for example, based on the detection result of the drum sensor 34) and may multiply the detected temperature of a noncontact temperature sensor 27 by the setup temperature correction coefficient, thereby correcting the detected temperature of the noncontact temperature sensor 27 so as to match the actual temperature of the surface of the heating roller 15.

Accordingly, the actual temperature of the heating roller 15 can be precisely acquired based on the detected temperature of the noncontact temperature sensor 27 regardless of change in the state of the air current accompanying change of the position of each photoconductive drum 5.

10. Applying of the Invention to Other Types of Image Forming Apparatus

The invention has been described by taking as an example the case where the noncontact temperature sensor 27 outputs a current flowing through the resistance element as a detection signal, the temperature correction unit 30A calculates the temperature (detected temperature) from the detection signal output by the noncontact temperature sensor 27 and corrects the calculated detected temperature, thereby calculating the actual temperature of the heating roller 15. However, the temperature correction unit 30A may correct the detection signal output by the noncontact temperature sensor 27 and may calculate the actual temperature of the heating roller 15 based on the post-corrected signal. In this case, the detection signal output by the noncontact temperature sensor 27 is an example of a value relevant to the temperature detected by the temperature detection member.

The noncontact temperature sensor 27 may find the temperature value responsive to the current flowing through the resistance element (the resistance value of the resistance element) and may output a data signal representing the temperature value (temperature data). In this case, the temperature correction unit 30A corrects the temperature data represented by the data signal output by the noncontact temperature sensor 27, thereby calculating the actual temperature of the heating roller 15.

In the embodiment described above, the noncontact temperature sensor 27 outputs the current flowing through the resistance element as a detection signal. However, a given current may be allowed to flow into the resistance element and the noncontact temperature sensor 27 may output the value of a voltage applied to the resistance element as a detection signal.

That is, when a given current is allowed to flow into the resistance element, if the radiation amount from the heating roller changes, the voltage of the resistance element changes and thus the voltage value can be adopted as a detection signal.

Although the tandem color printer 1 has been described, the invention can also be applied to a color printer of intermediate transfer type for transferring a toner image for each color from each image carrier to an intermediate transfer belt and then transferring the toner images from the intermediate transfer belt to a sheet in batch.

The invention can also be applied to a monochrome printer.

As described above, there is provided an image forming apparatus including an apparatus main unit; a detected unit being placed in the apparatus main unit; a temperature detection member being provided out of contact with the detected unit in the apparatus main unit for detecting a temperature of the detected unit; a change member for changing the state of an air current in the apparatus main unit (in other words, affecting change in the state of the air current); and a temperature correction unit for correcting a value relevant to the temperature detected by the temperature detection member based on change of the state of the air current by the change member.

For example, if the temperature detection member outputs a signal responsive to the temperature of the detected unit (detected temperature), the temperature correction unit may correct the signal output from the temperature detection member or may correct temperature data generated to represent the temperature from the output signal of the temperature detection member.

Also, according to one of the exemplary embodiments, the detected unit is a heating member for fixing a developer image onto a record sheet, the change member is a guide member being provided in the apparatus main unit so that the position of the member can be changed for guiding the record sheet with the developer image fixed thereonto by the heating member in a direction responsive to the position of the member, and the temperature correction unit corrects the value relevant to the temperature detected by the temperature detection member based on the position of the guide member.

Also, according to one of the exemplary embodiments, the guide member is formed as a part of the apparatus main unit and is provided as the position of the guide member can be changed between an open position for forming an opening in the apparatus main unit and a closed position for closing the opening.

Also, according to one of the exemplary embodiments, the image forming apparatus further includes a fan being provided in the apparatus main unit for forcibly exhausting air in the apparatus main unit to the outside and a fan capability change unit for changing the capability of the fan, wherein the change member is the fan, and wherein the temperature correction unit corrects the value relevant to the temperature detected by the temperature detection member based on the capability of the fan.

Also, according to one of the exemplary embodiments, the change member is a sheet feed tray being provided as the position of the sheet feed tray can be changed between an open position for forming an opening in the apparatus main unit and a closed position for closing the opening for feeding a record sheet into the apparatus main unit when the sheet feed tray is at the open position, and the temperature correction unit corrects the value relevant to the temperature detected by the temperature detection member based on the position of the sheet feed tray.

Also, according to one of the exemplary embodiments, the image forming apparatus further includes a heating roller being provided in the apparatus main unit for fixing a developer image onto a record sheet and a speed control unit for controlling the rotation speed of the heating roller, wherein the detected unit is the heating roller, wherein the change member is the heating roller, and wherein the temperature correction unit corrects the value relevant to the temperature detected by the temperature detection member based on the rotation speed of the heating roller.

Also, according to one of the exemplary embodiments, the image forming apparatus further includes a fixing unit being provided in the apparatus main unit for fixing a developer image onto a record sheet, the fixing unit including a heating member and a pressing member placed facing the heating member and provided as the position of the pressing member relative to the heating member can be changed, wherein the detected unit is the heating member, wherein the change member is the pressing member, and wherein the temperature correction unit corrects the value relevant to the temperature detected by the temperature detection member based on the position of the pressing member.

Also, according to one of the exemplary embodiments, the image forming apparatus further includes a belt being provided in the apparatus main unit for conveying a record sheet and a plurality of image formation members being provided so as to be able to be brought into and out of contact with the belt for forming an image on the record sheet conveyed by the belt, wherein the change member is the image formation member, and wherein the temperature correction unit corrects the value relevant to the temperature detected by the temperature detection member based on the position of each of the image formation members.

Also, according to one of the exemplary embodiments, an intake port for taking outside air into the apparatus main unit is formed in the apparatus main unit, and the image forming apparatus further includes an exhaust air dust having an inlet in the apparatus main unit for allowing air accepted through the inlet to circulate, wherein the inlet is placed at a position for allowing an air current to be formed from the intake port through the detected unit to the inlet.

According to one of the exemplary embodiments, the temperature detection member for detecting the temperature of the detected unit is provided out of contact with the detected unit in the apparatus main unit. The image forming apparatus is also provided with the change member for changing the state of an air current in the apparatus main unit. The value relevant to the temperature detected by the temperature detection member is corrected based on change of the state of the air current by the change member. Thus, the actual temperature of the detected unit can be precisely acquired based on the detected temperature of the noncontact temperature detection member regardless of change of the state of the air current by the change member.

According to one of the exemplary embodiments, the guide member for guiding the record sheet with the developer image fixed thereonto by the heating member is provided in the apparatus main unit so that the position of the guide member can be changed. When the position of the guide member is changed, the guide direction of the record sheet by the guide member changes and accordingly the state of the air current formed in the apparatus main unit (in the proximity of the heating member) is changed. The temperature correction unit corrects the value relevant to the temperature detected by the temperature detection member based on the position of the guide member. Thus, the actual temperature of the heating member of the detected unit can be precisely acquired based on the detected temperature of the noncontact temperature detection member regardless of change in the state of the air current accompanying the position change of the guide member.

According to one of the exemplary embodiments, the guide member is provided as the position of the guide member can be changed between the open position and the closed position. If the guide member is placed at the open position, an opening is formed in the apparatus main unit; if the guide member is placed at the closed position, the opening is closed by the guide member. Thus, the position of the guide member is changed between the open position and the closed position, whereby the opening is formed and closed and accordingly the state of the air current formed in the apparatus main unit is changed.

According to one of the exemplary embodiments, the fan for forcibly exhausting air in the apparatus main unit to the outside is provided in the apparatus main unit. The fan capability change unit changes the capability of the fan. When the capability of the fan is changed, the exhaust air current amount from the inside of the apparatus main unit to the outside changes and accordingly the state of the air current formed in the apparatus main unit is changed. The temperature correction unit corrects the value relevant to the temperature detected by the temperature detection member based on the capability of the fan. Thus, the actual temperature of the detected unit can be precisely acquired based on the detected temperature of the noncontact temperature detection member regardless of change in the state of the air current accompanying change of the capability of the fan.

According to one of the exemplary embodiments, the sheet feed tray for feeding a record sheet into the apparatus main unit is provided as the position of the sheet feed tray can be changed between the open position and the closed position. If the sheet feed tray is placed at the open position, an opening is formed in the apparatus main unit; if the sheet feed tray is placed at the closed position, the opening is closed by the sheet feed tray. Thus, the position of the sheet feed tray is changed between the open position and the closed position, whereby the opening is formed and closed and accordingly the state of the air current formed in the apparatus main unit is changed. The temperature correction unit corrects the value relevant to the temperature detected by the temperature detection member based on the position of the sheet feed tray. Thus, the actual temperature of the detected unit can be precisely acquired based on the detected temperature of the noncontact temperature detection member regardless of change in the state of the air current accompanying the position change of the sheet feed tray.

According to one of the exemplary embodiments, the heating roller for fixing a developer image onto a record sheet is provided in the apparatus main unit. The speed control unit controls (changes) the rotation speed of the heating roller in response to the thickness of the record sheet, for example. When the rotation speed of the heating roller is changed, the conveying speed of the record sheet changes and accordingly the state of the air current formed in the apparatus main unit (in the proximity of the heating roller) is changed. The temperature correction unit corrects the value relevant to the temperature detected by the temperature detection member based on the rotation speed of the heating roller. Thus, the actual temperature of the heating roller of the detected unit can be precisely acquired based on the detected temperature of the noncontact temperature detection member regardless of change in the state of the air current accompanying change of the rotation speed of the heating roller.

According to one of the exemplary embodiments, the fixing unit for fixing a developer image onto a record sheet is provided in the apparatus main unit. The fixing unit includes the heating member and the pressing member. The pressing member is placed facing the heating member and is provided as the position of the pressing member relative to the heating member can be changed. When the position of the pressing member relative to the heating member is changed, the conveying passage of the record sheet is changed in the proximity of the heating member and accordingly the state of the air current formed in the apparatus main unit (in the proximity of the heating member) is changed. The temperature correction unit corrects the value relevant to the temperature detected by the temperature detection member based on the position of the pressing member relative to the heating member. Thus, the actual temperature of the heating member of the detected unit can be precisely acquired based on the detected temperature of the noncontact temperature detection member regardless of change in the state of the air current accompanying change of the position of the pressing member.

According to one of the exemplary embodiments, the belt for conveying a record sheet and a plurality of image formation members for forming an image on the record sheet conveyed by the belt are provided in the apparatus main unit. The image formation members are provided so as to be able to be brought into and out of contact with the belt. For example, when a color image is formed on a record sheet, all image formation members are placed at positions where they come in contact with the belt. On the other hand, when a monochrome image is formed on a record sheet, to suppress consumption of the image formation members, preferably other image formation members than the image formation member for forming a black image are brought out of contact with the belt. When the position of each of the image formation members is changed, the state of the air current formed in the apparatus main unit is changed accordingly. The temperature correction unit corrects the value relevant to the temperature detected by the temperature detection member based on the position of each of the image formation members. Thus, the actual temperature of the detected unit can be precisely acquired based on the detected temperature of the noncontact temperature detection member regardless of change in the state of the air current accompanying change of the position of each of the image formation members.

According to one of the exemplary embodiments, the intake port for taking outside air into the apparatus main unit is formed in the apparatus main unit. The inlet of the exhaust air dust is placed in the apparatus main unit. An air current from the intake port through the detected unit to the inlet is formed in the apparatus main unit, and the air reaching the inlet circulates through the exhaust air dust. Since the air current passes through the detected unit, if the change member changes the state of the air current, the detected temperature of the temperature detection member fluctuates. The temperature correction unit corrects the value relevant to the temperature detected by the temperature detection member based on the position of each of the image formation members. Thus, the actual temperature of the detected unit can be precisely acquired based on the detected temperature of the noncontact temperature detection member regardless of change in the state of the air current accompanying change of the position of each of the image formation members.

According to one of the exemplary embodiments, an air current sensor configured to detect a state of an air current in the main casing 2 is further provided, and the controller 30 corrects the detected temperature of the noncontact temperature sensor 27 based on a detection of the air current sensor.

Further, "correcting the detected temperature of the noncontact temperature sensor" also includes a meaning of correcting a control signal for the heater, the control signal being based on the detected temperature of the noncontact temperature sensor.

What is claimed is:

1. An image forming apparatus comprising:

an apparatus main unit;

a detected unit that is placed in the apparatus main unit;

a temperature detection member that is provided out of contact with the detected unit in the apparatus main unit, the temperature detection member configured to detect a temperature of the detected unit;

a change member configured to change a state of an air current in the apparatus main unit;

a temperature correction unit configured to correct a value relevant to the temperature detected by the temperature detection member based on the state change of the air current by the change member; and a fixing unit that is provided in the apparatus main unit and is configured to fix a developer image onto a sheet, the fixing unit comprising a heating member and a pressing member placed facing the heating member and provided as a position of the pressing member relative to the heating member, wherein the detected unit is the heating member, the change member is the pressing member, and the temperature correction unit is configured to correct the value relevant to the temperature detected by the temperature detection member based on the position of the pressing member.

2. The image forming apparatus according to claim 1, wherein an intake port for taking outside air into the apparatus main unit is formed in the apparatus main unit, the image forming apparatus further comprising an exhaust air dust having an inlet in the apparatus main unit configured to allow air accepted through the inlet to flow, and the inlet is placed at a position configured to allow an air current to be formed from the intake port through the detected unit to the inlet.

3. An image forming apparatus comprising:

an apparatus main unit;

a detected unit that is placed in the apparatus main unit;

a temperature detection member that is provided out of contact with the detected unit in the apparatus main unit, the temperature detection member configured to detect a temperature of the detected unit;

a change member configured to change a state of an air current in the apparatus main unit;

a temperature correction unit configured to correct a value relevant to the temperature detected by the temperature detection member based on the state change of the air current by the change member;

a belt that is provided in the apparatus main unit and configured to convey a sheet; and an image formation member that is configured to be brought into and out of contact with the belt for forming an image on the sheet conveyed by the belt, wherein the change member is the image formation member, and the temperature correction unit is configured to correct the value relevant to the temperature detected by the temperature detection member based on a position of the image formation member.

4. The image forming apparatus according to claim 3, wherein an intake port for taking outside air into the apparatus main unit is formed in the apparatus main unit, the image forming apparatus further comprising an exhaust air duct having an inlet in the apparatus main unit configured to allow air accepted through the inlet to flow, and the inlet is placed at a position configured to allow an air current to be formed from the intake port through the detected unit to the inlet.

* * * * *